US006079598A

United States Patent [19]

Tsai

[11] Patent Number: 6,079,598

[45] Date of Patent: Jun. 27, 2000

[54] MODULAR PANTS HANGING UNIT

[76] Inventor: Daniel Tu-Hsien Tsai, 7033 Burnside Dr., San Jose, Calif. 95120

[21] Appl. No.: 09/157,359

[22] Filed: Sep. 19, 1998

Related U.S. Application Data

[63] Continuation-in-part of application No. 09/097,416, Jun. 15, 1998.

[51] Int. Cl.[7] ..... A47G 25/48; A47G 25/44

[52] U.S. Cl. ..... 223/96; 223/95

[58] Field of Search ..... 223/96, 95, 93, 223/91, 85; 24/570, 530, 54, 560

[56] References Cited

U.S. PATENT DOCUMENTS

| | | | |
|---|---|---|---|
| 143,024 | 9/1873 | Mellish | 24/570 |
| B 333,711 | 8/1967 | Helmer et al. | 223/95 |
| 707,192 | 8/1902 | Aiken . | |
| 853,527 | 5/1907 | Tye . | |
| 1,487,083 | 3/1924 | Zimmerman | 24/570 |
| 2,127,333 | 8/1938 | Hall . | |
| 2,215,336 | 9/1940 | Romano | 223/96 |
| 2,431,976 | 12/1947 | Ajax | 223/96 |
| 2,492,325 | 12/1949 | Schroeder . | |
| 2,952,367 | 9/1960 | Creveling et al. . | |
| 3,343,734 | 9/1967 | Merriman | 223/96 |
| 3,897,893 | 8/1975 | Lemmenes | 223/96 |
| 5,361,949 | 11/1994 | Petrou | 223/96 |
| 5,579,965 | 12/1996 | Turner | 223/96 |
| 5,607,066 | 3/1997 | Hebberd . | |

*Primary Examiner*—Bibhu Mohanty
*Attorney, Agent, or Firm*—Leonard Heyman

[57] ABSTRACT

A pants hanger is comprised of fixed horizontally extending hanging arms and spring elements. Each spring element is attached to one side of a hanging arm and is biased against the opposite side of the adjacent hanging arm. The hanging arms and spring elements may receive a pair of pants or other garment between them. The garment is then supported by the compressive, gripping force of the spring being biased against the adjacent hanging arm. The unit may be combined with other like units to provide an array of hangers, disposed either vertically or horizontally.

35 Claims, 4 Drawing Sheets

MODULAR PANTS HANGING UNIT

CROSS-REFERENCE TO RELATED APPLICATIONS

This application is a Continuation-In-Part of application Ser. No. 09/097,416 which was filed on Jun. 15, 1998.

BRIEF SUMMARY OF THE INVENTION

BACKGROUND

This invention relates to a hanger for one or more pairs of pants, in particular, it relates to a pants hanger having a stationary arm and a spring or springs biased against said arm to provide pressure for gripping a pair of pants between the spring or springs and the arm.

Numerous types of pants or trousers hangers have been disclosed over a long period of time. U.S. Pat. No. 707,192 issued to Aiken describes a trousers supporter having parallel rods. The spacing between two rods is barely sufficient to receive the four thicknesses of the trousers material but not wide enough to receive eight thicknesses of material which occurs at the seam portion at the extreme end of the trouser legs. Since this hanger is not adjustable, it is limited to certain trousers with a specific material thickness. This limitation makes this type of hanger unsuitable with the wide variety of materials and thicknesses now available.

U.S. Pat. No. 2,492,325 to Schroeder describes a combination hanger comprised of plurality of spaced parallel arms. The arms are spaced to receive the cuffs of men's trousers between an adjacent pair, however other garments can be draped over the arms as well. Since the arms are fixed with respect to each other, this pants hanger suffers from the same limitation as the above pants hanger with regard to the intended method of supporting pants. As to draping garments over the arms, the lack of a gripping arm requires careful balancing of the garment over the arm to prevent the garment from sliding off and falling to the floor, where it will inevitably become wrinkled or soiled.

U.S. Pat. No. 4,557,407 to Bogaczyk describes a pants hanger having parallel bars in which a pair of pants are held between a pair of bars by the friction force between the surface of bars and pants. This technique is very sensitive to the fabric materials or fabric thickness and is likewise not suitable for hanging wide variety of pants.

U.S. Pat. No. 853,527 to Tye discloses a trousers hanger with a plurality of fingers proximally mounted to a plurality of corresponding pins which are parallel to each other and vertically disposed, enabling the distal end of each finger to swing horizontally. The distal ends of the first and last fingers are urged together by a compressed spring between the extended proximal ends of the two fingers on the opposite side of the pins. Since only the distal ends of the fingers are compressed together, this hanger does not provide a pressure along the length of the fingers. As a result, the weight of the pants pulling on one side can pull and stretch the pants material with undesirable results.

U.S. Pat. No. 2,127,333 to Hall et al. discloses a garment hanger with a plurality of pairs of fingers. Each pair of fingers are connected at a proximal end to each other and are free at the distal ends. Furthermore, the free ends of each pair are compressed together by a bolt and nut adjacent the proximal end of the gripping fingers. This patent suffers from the same disadvantage as the previous patent, in that only the distal ends of each pair are compressed together, which can result in misshaped pants due to uneven stretching and pulling of the fabric.

U.S. Pat. No. 5,607,066 to Hebberd discloses a pants rack assembly having two rigid outer fingers and two floating inner fingers which are pressed against the outer fingers by two springs disposed between them. The springs are supported by an additional spring support arm disposed between the two inner fingers. This patent can support two pairs of pants between two finger gripping members but it requires a middle spring support arm which increases manufacturing costs and thus increases the price of the assembly. Additionally, the presence of the two coil springs prevent a person from draping a garment, such as a skirt, necktie, or other item, over one of the inner fingers. If several of these assemblies were to be placed next to each other, it would be difficult to figure out which fingers are stationary and which fingers are floating to determine which way drape the article of clothing.

Accordingly, none of the prior art hangers provide a simple construction for providing pressure along the length of a supporting arm to grip a garment. It is therefore an object of this invention to provide a pants hanger which simplifies the pants hanging process and suffers from none of the disadvantages of the prior art. It is another object of the invention to provide a modular hanging unit that can be easily assembled into hanging array for hanging and draping multiple pairs of pants. It is also an object of the invention to provide an integrated hanging rack for hanging and draping multiple pairs of pants. It is yet another objective of this invention that extend the above mention objectives to hanging skirt, neck tie and other items. It is finally an object of this invention to provide all of the features in a device which is inexpensive to manufacture.

SUMMARY

The embodiments of the present invention extend, for the purpose of reducing manufacturing costs, the embodiments set forth in the copending application 09/097,416, which was filed Jun. 15, 1998, and is hereby incorporated by reference. The embodiments disclosed in the present application are directed towards pants hangers which obtain a gripping force by biasing a spring or springs between two stationary arms. The spring or springs serve both as a guide during the insertion of a garment between the two stationary arms and as a source of gripping pressure, thereby reducing the complexity and manufacturing costs when compared with the hanger disclosed in the copending application.

In a first embodiment, a plurality of springs formed from spring wire are mounted to a first stationary arm and gently curves out to apply pressure against a second stationary arm. The shape of the spring provides a smooth guide for inserting garments between the two arms for hanging, but also maintains the garments in position by gripping them between the spring and the second stationary arm.

Each Spring element may be attached at one end to the first stationary arm, having a single resilient biasing region, or it may be attached at both ends to the first stationary arm and have two resilient biasing regions on either side of the contact region which functions to grip and hold the garment in place.

The remaining embodiments provide for various shaped flat metal springs which serve the same function and operate in substantially the same way as the formed wire springs. The flat metal springs provide a greater surface area of contact against the garment, which permits more evenly-distributed pressure, which reduces the likelihood of damage to a garment due to stretching and pulling of the fabric. Secondly, the flat metal springs may be cheaper to produce due to fewer steps in manufacturing.

DETAILED DESCRIPTION OF THE PREFERRED EMBODIMENTS

Figure 1:
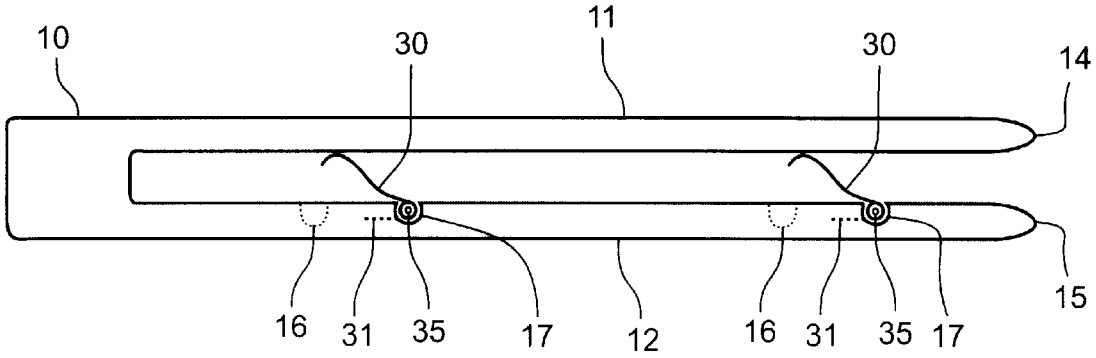
FIG. 1 shows an assembled pants hanger according to a first embodiment of the invention in top view.

The first embodiment of the invention is shown in FIGS. 1 through 4. FIG. 1 shows the invention according to the first embodiment in top down, or plan view. The invention comprises a pants hanger having a common block 10 from which two fixed parallel arms 11 and 12 extend. The invention would work equally well if these two arms were reversed, serving each others' functions, e.g., if the invention were to be turned upside-down. Left arm 12 has two spring elements 30 mounted to it. Arms 11 and 12 are formed integrally with common block 10 but need not be.

Figure 2:
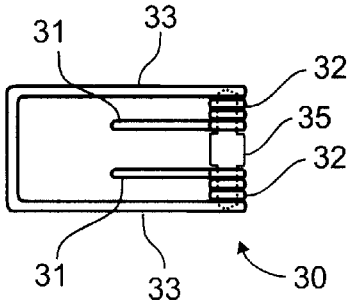
FIG. 2 shows torsion springs of FIG. 1 in top view.
Figure 3:
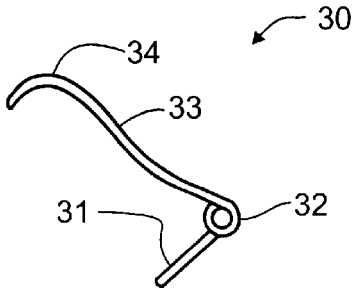
FIG. 3 shows torsion springs of FIG. 1 in side view.

Each spring element 30, shown separately in side view in FIG. 2 and top view in FIG. 3, are formed from a single piece of spring wire, and include two mounting terminals 31, two torsion spring sections 32, and spring arm 33. Terminals 31 fit into terminal receiving channels formed into arm 12 and torsion spring sections 32 fit over posts 35 formed into arm 12. Receiving channels may be simply holes into which terminals 31 extend, or grooves formed in the upper and lower surface of arm 12. Torsion springs 32 fit snugly into torsion spring coil housing cavity 17. Posts 35 are shown in profile in FIG. 2 for clarity, but may be integrally formed in arm 12 or eliminated altogether. When smaller spring wire size is used, posts 35 add additional mechanical support to coils 32.

Figure 4:
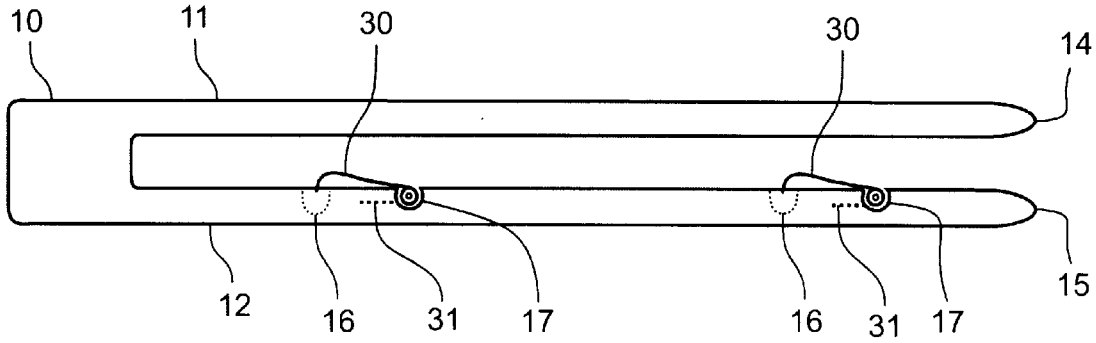
FIG. 4 shows the pants hanger of FIG. 1 with the torsion springs in a compressed condition, as when a pair of pants are hung therein.

Each spring 30 is biased in an "open" condition shown in FIG. 3, but is compressed slightly by arm 11 when installed onto arm 12. Each spring 30 includes contact region 34 which is biased against arm 11 when installed. Contact region 34 grips an article of clothing slipped between arms 11 and 12 to support the article in a hanging condition. When clothes are present between arms 11 and 12, springs 30 are placed in a compressed condition as shown in FIG. 4, and the free ends of springs 30 may be forced into respective cavities 16 formed into the body of arm 12. Cavities 16 permit the springs to deform to such an extent that the springs provide nearly as much clearance between the springs themselves and arm 12 as would be if the springs were not present at all between arms 11 and 12 without sacrificing the gently curving shape of springs 30 which allow clothing to be easily inserted and removed past spring elements 30.

Figure 5:
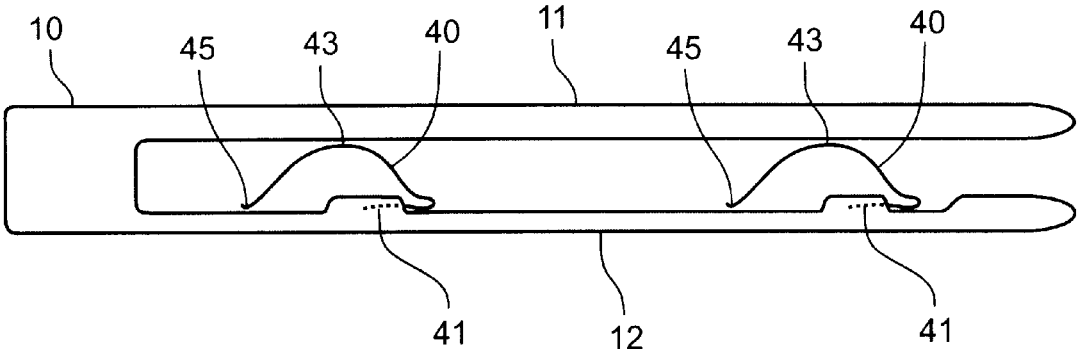
FIG. 5 shows a pants hanger assembly according to a second embodiment in which the spring element comprises flat springs.
Figure 6:
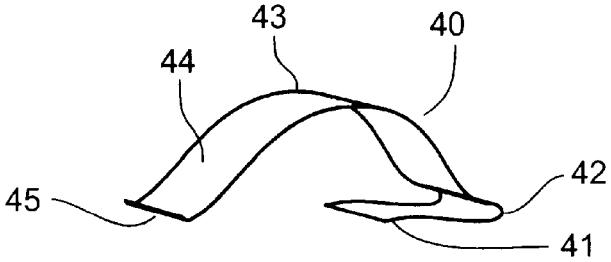
FIG. 6 is perspective view of a spring from the embodiment shown in FIG. 5.

FIGS. 5 and 6 show a second embodiment according to the invention. This embodiment is similar to the previous one, except that spring elements 40 are formed from stamped, flat metal springs instead of spring wire. Flat metal springs 40 provide a greater area of pressure against an article of clothing supported by them than do spring wire springs 30 of the previous embodiment. Springs 40 are formed in the same basic shape as springs 30 in the previous embodiment, but due to their simpler structure, they are easier to manufacture and attach to arm 12 of the hanger unit.

Each spring 40 includes a mounting terminal 41 which is embedded into hanger arm 12, a substantially U-shaped resilient biasing region 42 which takes most of the bending stress when the spring is deformed, contact region 43 which serves to compress an article of clothing against arm 11, ramp region 44 to prevent bunching or jamming when removing an article of clothing, and spring end 45, which always remains in contact with arm 12, also to provide for easy removal of the article of clothing.

Figure 7:
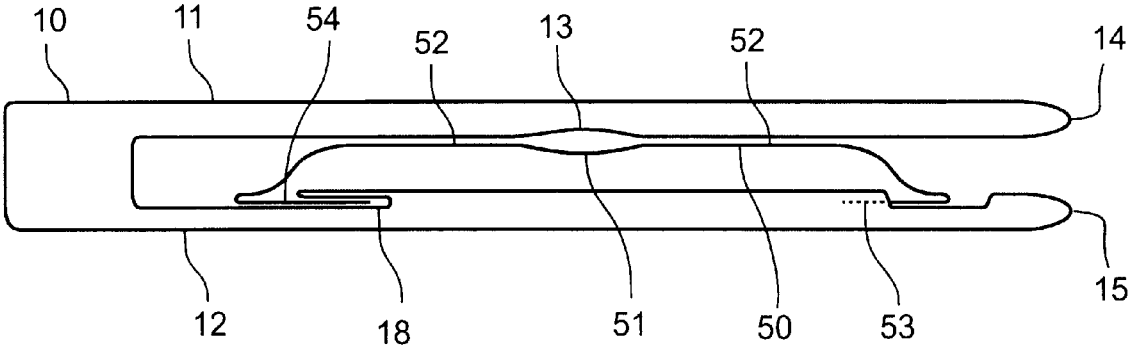
FIG. 7 shows another embodiment having a single flat spring that exerts wide, uniform compression over large contact surface.
Figure 8:
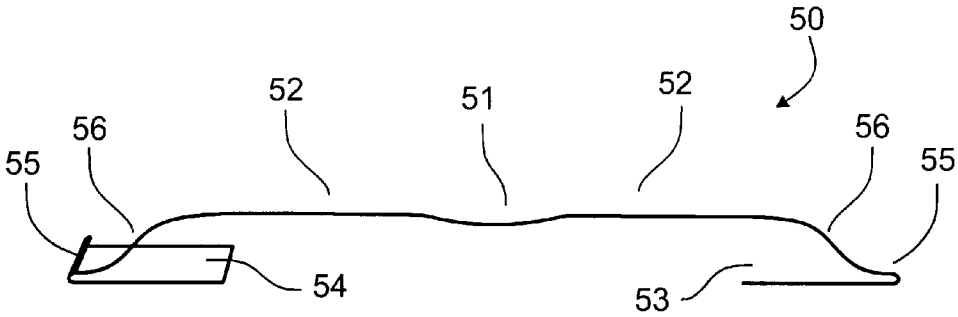
FIG. 8 shows a perspective view of the spring element of FIG. 7.
Figure 9:
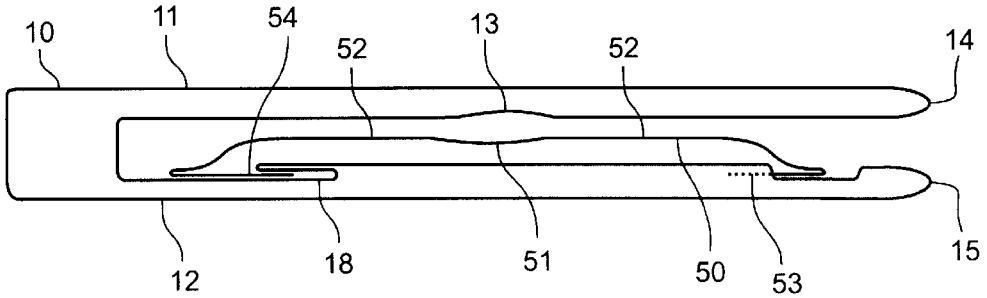
FIG. 9 shows the pants hanger of FIG. 7 with the spring in a state of compression, as when a pair of pants are hung therein.

FIGS. 7, 8, and 9 show a third embodiment according to the invention. In this embodiment, a single spring is employed which extends a majority of the length of arm 12. The single long spring element with two resilient biasing points 55 provides even greater surface contact area and more uniform pressure against a garment than previous embodiments and is assembled with fewer parts.

Spring 50 includes recess region 51 at about the mid-point along its length which lines up with recess region 13 formed in arm 11 of hanger unit 10. The recess regions 13 and 51 are designed to accommodate the seams on pants legs which are usually found at about the mid point between creases. Spring 50 is shown in perspective view in FIG. 8, and it is formed from a single piece of stamped flat metal spring, and it includes two terminals 53 and 54, two substantially U-shaped resilient biasing regions 55, two ramp portions 56, and two contact regions 52 formed on either side of recess 51. Terminal 53 is embedded in left arm 12, and is therefore fixed in place. Contact regions 52 and recess portion 51 may be stiffened by being bent along both edges or by being corrugated lengthwise to minimize bending under pressure. If formed from plastic, the contact regions 52 and recess portion 51 may be stiffened by having ribs formed and extending along the side opposite arm 11. U-shaped bend 55 and ramp portion 56 located adjacent to terminal 53 and the U-shaped bend 55 and ramp portion 56 located adjacent to terminal 54 assert substantially independent biasing force toward right arm 11 and apply uniform pressure against the right arm 11 through contact regions 52. Spring 50 flattens out when compressed, and terminals 53 and 54 are urged away from each other as shown in FIG. 9. Because of this, terminal 54 slides part way out of its slot 18 but is still retained by the slot when spring 50 is compressed as shown in FIG. 9. Ramps 56 permit a garment to be smoothly inserted and removed without undue pulling, jamming, or stretching on the garment.

Figure 10:
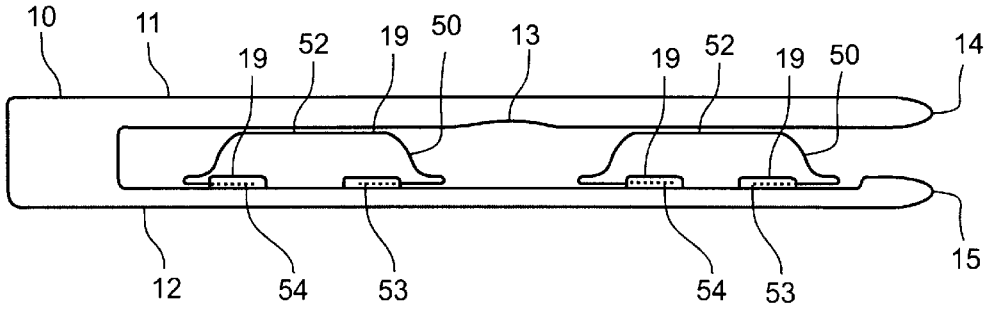
FIG. 10 shows yet another embodiment including two flat metal springs, each operating in a manner similar to the one spring shown in the embodiment of FIG. 7.

FIG. 10 shows a variation on the previous embodiment in which a plurality of spring elements, each having two substantially U-shaped resilient biasing regions, are provided along the length of the hanger. This embodiment shows that a majority of the benefits derived from the previous, single-spring embodiment can also be enjoyed by employing more than one spring. In particular, a large surface area of compression to grip the garment, a relatively even distribution of pressure against a garment, easy insertion and removal of the garment, etc. Springs 50 each have two ends 54 and 53, which may both slide freely inside their respective slots, or may have one free end and one fixed end as the spring 52 shown in FIGS. 7 through 9.

Figure 11:
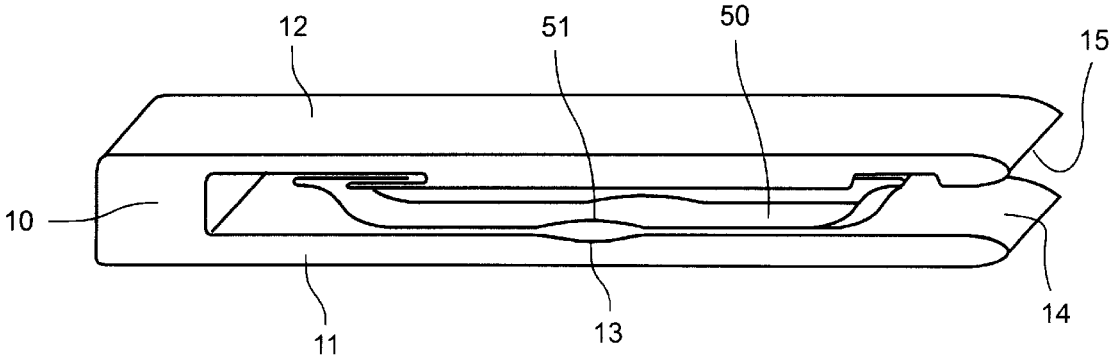
FIG. 11 shows an isometric view of a variation of the embodiment of FIG. 7 in which the hanger is rotated ninety degrees and the spring element is mounted to the upper arm and applies pressure to the lower arm.

The orientation of the hanger is not material to its utility as a hanger for garments. If very long garments are required to be hung in a space not tall enough to accommodate the full length of the garments, it may be desirable to rotate the hanger 90° as shown in FIG. 11 and drape the garment over the lower arm. While FIG. 11 shows the hanger shown in FIG. 7 at a different angle, any hanger disclosed herein may be rotated for a similar effect. In fact, any hanger according to the invention will operate substantially the same regardless of the angle at which it is rotated.

Figure 12:
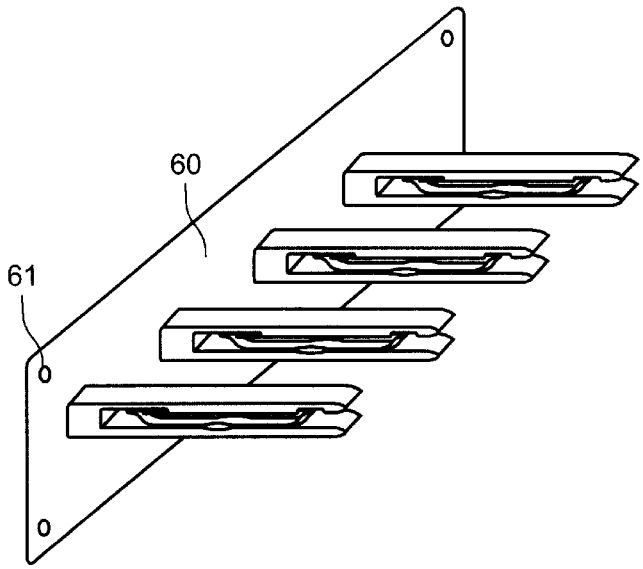
FIG. 12 shows a plurality of the pants hangers of FIG. 11 formed integrally as a unit.

Each hanger embodiment disclosed herein may be arranged in an array of hangers, where each hanger is but one module of many. Each hanger module can be mounted to, or formed integrally with, a common support as shown in FIG. 12.

Figure 13:
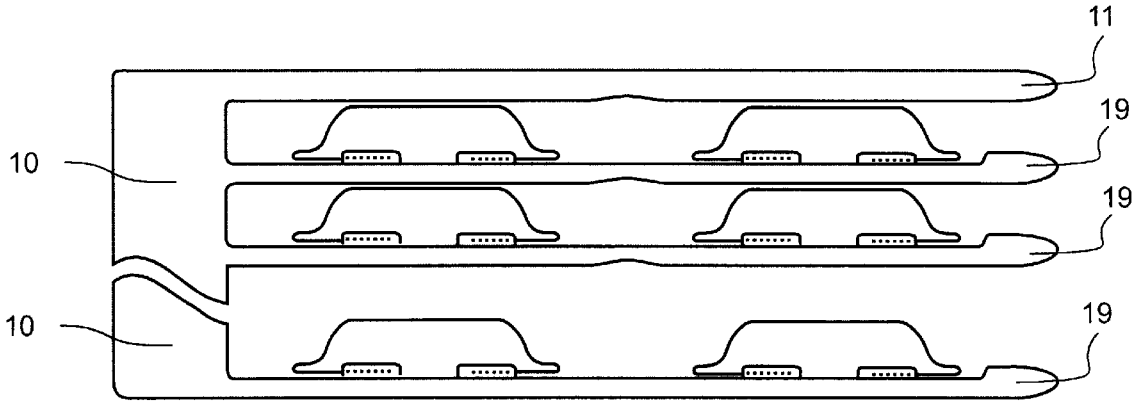
FIG. 13 a multiple pants hanging unit having multiple hanging arms. One side of each hanging arm supports the biasing spring which compresses against the adjacent hanging arm and hang a pair pants are hanged between the other side of each hanging arm and the spring supported by the adjacent hanging arm.

FIG. 13 shows a plurality of hangers according to the embodiment shown in FIG. 10 wherein each support arm may be formed integrally with common block 10 or they may be mounted to common block 10. In this example, each support arm except the outer two are common to adjacent hangers. Thus each support arm, except the outer two, serve both as a spring support for one hanging unit on one side and a gripper surface for another hanging unit on its other side. In this way a plurality of closely spaced units can be easily fit into a small space.

A person of ordinary skill may certainly envision other enhancements or alterations to the embodiments set forth above without departing from the spirit and scope of the invention. For example, the hanger bodies and springs may be formed of varying materials. Plastic springs, for example, may be used in place of metal wire or flat metal springs. The hanger bodies may be formed of ceramic, wood, glass, or metal instead of plastic. Composite plastic may be desired for the hanger body. The modularity of the hangers can be improved by providing snapping fixtures to permit them to be snapped together to create any size array of hangers to fit any available space. The hangers may be mounted for rotation along a vertical axis at their bases to permit easy viewing of the hung garments to select among them. The hangers may be mounted to a vertical pole for display purposes, or to satisfy other requirements of the available space.

Having now particularly described the preferred embodiments of the invention, it is understood that the scope of protection sought is not defined by the detailed description set forth above, but by the claims appended hereto.

I claim:

1. A pants hanging unit comprising:

two arms extending horizontally from a common base parallel and in close proximity to one another, said two arms being substantially rigid and fixed with respect to one another and said base and defining an insertion space between them, said insertion space being sufficiently long to substantially accommodate the width of a garment to be inserted therein; and at least one spring element mounted to a first of said two arms and exerting pressure directly against a second of said two arms, said at least one spring element having significantly greater elasticity than said arms, said spring element being deformable to accommodate varying thicknesses of garments as one such garment may be inserted between said two arms, and thereupon applying a gripping pressure against said garment adequate to support said garment in said insertion space between said two arms.

2. The pants hanging unit set forth in claim 1 wherein said at least one spring element comprise at least one metal wire spring, each said metal wire spring comprising at least one resilient biasing region and an extended contact area biased outward from said first arm.

3. The pants hanging unit of claim 2 wherein said extended contact area provides a gently curving surface to acting to guide a garment between said contact area and said second arm when inserting and removing said garment from the unit.

4. The pants hanging unit of claim 2 wherein each said at least one resilient biasing region comprises two torsion springs which fit in recessed spring coil housing cavities formed said first arm to prevent said torsion springs from partially obstructing said insertion space.

5. The pants hanging unit of claim 4 wherein said first arm also includes a cavity into which said extended contact area may extend when said at least one spring element is compressed against said first arm.

6. The pants hanging unit as set forth in claim 2 wherein each spring element comprises two end terminals which are held in a fixed position by said first arm, two resilient biasing regions each adjacent a respective end terminal, two extended arms each adjacent a respective resilient biasing region and curving outward towards and biased towards said second arm, and a curved contact area adjacent and between said extended arms.

7. The pants hanging unit as set forth in claim 2 wherein said at least one spring element comprises at least two substantially identical spring elements.

8. The pants hanging unit as set forth in claim 6 wherein said at least one spring element comprises at least two substantially identical spring elements.

9. The pants hanging unit set forth in claim 1 further comprising at least one additional arm formed parallel to said first and second arms and adjacent to one of said first and second arms and lying in the same plane as said first and second arms, each said additional arm defining an additional insertion space each having at least one spring element therein for supporting a garment.

10. The pants hanging unit set forth in claim 9 wherein each additional insertion space has on either side a first and second arm and each said spring element in said additional insertion spaces being attached to said first arm of said each additional insertion space and biasing a contact portion of said spring element against said second arm of said each additional insertion space.

11. The pants hanging unit set forth in claim 1 further comprising a mounting surface, said mounting surface providing support for said pants hanging unit and any number of additional pants hanging units.

12. The pants hanging unit set forth in claim 1 wherein each said at least one spring comprises at least one mounting portion and at least one contact portion, each of said at least one mounting portion being held by said first arm, and each of said at least one contact portion being biased against said second arm when no garment is in said insertion space and against said garment when said garment is in said insertion space, each said at least one spring further comprising a resilient biasing region between each said at least one mounting portion and one of said at least one contact portion.

13. The pants hanging unit set forth in claim 12 wherein said at least one mounting portion is held in sliding relation to said first arm.

14. The pants hanging unit set forth in claim 12 wherein for each said at least one spring, said at least one mounting portion comprises a single mounting portion and said at least one contact portion extends from said mounting portion in one of a direction away from said common base along a length of said arms and towards said common base along a length of said arms.

15. The pants hanging unit set forth in claim 12 wherein said at least one contact portion of each spring extends along said arms between at least two of said at least one mounting portion.

16. A pants hanging unit comprising:

two arms extending horizontally from a common base parallel and in close proximity to one another, said two arms being substantially rigid and fixed with respect to one another and said base and defining an insertion space between them, at least one spring element mounted to a first of said two arms and exerting pressure directly against a second of said two arms, said spring element having significantly greater elasticity than said arms, said spring element being deformable to accommodate varying thicknesses of garments as one such garment may be inserted between said two arms, and thereupon applying a gripping pressure against said garment adequate to support said garment in said insertion space between said two arms;

wherein each said at least one spring element comprises a flat spring having a first end held fixed by said first arm, a resilient biasing region adjacent to said first end, a first sloping region adjacent said resilient biasing region and extending and biased towards said second arm, a curved contact region adjacent said first sloping region for gripping said garment, a second sloping region adjacent said contact region and extending back to said first arm and a second end which maintains contact with said first arm by virtue of said spring's elasticity and shape.

17. The pants hanging unit as set forth in claim 16 wherein said first and second sloping regions guide a garment between said contact region and said second arm when inserting and removing said garment from the unit and said second end maintains contact with said first arm during insertion and removal of said garment.

18. The pants hanging unit as set forth in claim 16 wherein said at least one spring comprises at least two springs.

19. A pants hanging unit comprising:

two arms extending horizontally from a common base parallel and in close proximity to one another, said two arms being substantially rigid and fixed with respect to one another and said base and defining an insertion space between them, at least one spring element mounted to a first of said two arms and exerting pressure directly against a second of said two arms, said spring element having significantly greater elasticity than said arms, said spring element being deformable to accommodate varying thicknesses of garments as one such garment may be inserted between said two arms, and thereupon applying a gripping pressure against said garment adequate to support said garment in said insertion space between said two arms; and each said at least one spring element comprises a flat spring having a first end held adjacent to said first arm, a first resilient biasing region adjacent to said first end, a first sloping region adjacent said first resilient biasing region and extending and biased towards said second arm, a contact region adjacent said first sloping region for gripping said garment, and a second sloping region adjacent said contact region and extending back to said first arm.

20. The pants hanging unit as set forth in claim 19 wherein each said spring element further comprises a second resilient biasing region adjacent to said second sloping region and a second end is inserted into a cavity in said first arm which permits said second end to slide along said first arm, but is prevented from separating from said first arm.

21. The pants hanging unit as set forth in claim 20 wherein at least one of said first and second end is inserted into a cavity formed in said first arm and extending in the direction of said first arm, permitting said at least one end to slide in the direction of said first arm to accommodate the tendency of the ends to spread when the spring element is compressed against said first arm.

22. The pants hanging unit as set forth in claim 21 wherein said at least one spring element comprises at least two substantially identical spring elements.

23. The pants hanging unit set forth in claim 20 wherein said at least one spring element comprises it least two substantially identical spring elements.

24. The pants hanging unit set forth in claim 20 wherein in both of said first and second ends are inserted into a cavity formed in said first arm and extending in the direction of said first arm, permitting said at least one end to slide in the direction of the first arm to accommodate the tendency of the ends to spread when the spring element is compressed against said first arm.

25. The pants hanging unit set forth in claim 20 wherein said at least one spring comprises a single spring and said contact region extends a majority of the length of said second arm.

26. The pants hanging unit set forth in claim 25 wherein said contact region includes a recess portion approximately halfway down its length to accommodate a thicker seams region found in most pants halfway between its creases.

27. The pants hanging unit set forth in claim 25 wherein said contact region includes stiffening means.

28. The pants hanging unit set forth in claim 27 wherein said stiffening means comprises corrugations in the longitudinal direction of said spring element.

29. The pants hanging unit set forth in claim 27 wherein said stiffening means comprises bent regions long the sides of said contact regions.

30. The pants hanging unit set forth in claim 16 further comprising at least one additional arm formed parallel to said first and second arms and adjacent to one of said first and second arms and lying in the same plane as said first and second arms, each said additional arm defining an additional insertion space each having at least one spring element therein for supporting a garment.

31. The pants hanging unit set forth in claim 30 wherein each additional insertion space has on either side a first and second arm and each said spring element in said additional insertion spaces being attached to said first arm of said each additional insertion space and biasing a contact portion of said spring element against said second arm of said each additional insertion space.

32. The pants hanging unit set forth in claim 19 further comprising at least one additional arm formed parallel to said first and second arms and adjacent to one of said first and second arms and lying in the same plane as said first and second arms, each said additional arm defining an additional insertion space each having at least one spring element therein for supporting a garment.

33. The pants hanging unit set forth in claim 32 wherein each additional insertion space has on either side a first and second arm and each said spring element in said additional insertion spaces being attached to said first arm of said each additional insertion space and biasing a contact portion of said spring element against said second arm of said each additional insertion space.

34. The pants hanging unit set forth in claim 20 further comprising at least one additional arm formed parallel to said first and second arms and adjacent to one of said first and second arms and lying in the same plane as said first and second arms, each said additional arm defining an additional insertion space each having at least one spring element therein for supporting a garment.

35. The pants hanging unit set forth in claim 34 wherein each additional insertion space has on either side a first and second arm and each said spring element in said additional insertion spaces being attached to said first arm of said each additional insertion space and biasing a contact portion of said spring element against said second arm of said each additional insertion space.

* * * * *